United States Patent [19]

Oshima et al.

[11] 4,152,999

[45] May 8, 1979

[54] ICE-BREAKING APPARATUS FOR SHIPS AND BARGES FOR OPERATION ON ICY WATERS

[75] Inventors: Masanao Oshima, Tokyo; Hiroshi Tabuchi, Yokohama; Tsuneo Inokawa, Tokyo, all of Japan

[73] Assignee: Mitsui Engineering and Shipbuilding Co., Ltd., Tokyo, Japan

[21] Appl. No.: 857,616

[22] Filed: Dec. 5, 1977

[51] Int. Cl.[2] ..... B63B 35/08

[52] U.S. Cl. ..... 114/42

[58] Field of Search ..... 114/40, 41, 42

[56] References Cited

U.S. PATENT DOCUMENTS

| | | | |
|---|---|---|---|
| 3,572,273 | 3/1971 | Wood | 114/40 |
| 3,878,804 | 4/1975 | Legerer | 114/40 |
| 3,977,345 | 8/1976 | Worthing | 114/40 |

FOREIGN PATENT DOCUMENTS

| | | | |
|---|---|---|---|
| 510414 | 8/1976 | U.S.S.R. | 114/40 |

*Primary Examiner*—Charles E. Frankfort
*Assistant Examiner*—Jesus D. Sotelo
*Attorney, Agent, or Firm*—Armstrong, Nikaido, Marmelstein & Kubovcik

[57] ABSTRACT

An ice-breaking apparatus for use in ships and barges operating on icy waters, including nozzles for jetting high pressure fluid, is disclosed. By impinging force or cavitation caused by the high pressure fluid jetted from the nozzles, grooves or cracks are formed on an ice floe, and then, the ice floe is broken from these grooves or cracks by the hull. This ice-breaking apparatus facilitates breakage of ice floes or the like, and when this ice-breaking apparatus is attached, ships or barges for operation on icy waters can be built without increasing dimensions or propulsion powers particularly for navigation on icy waters. The ice-breaking apparatus includes echo distance measuring apparatus for automatically controlling and maintaining the nozzles at optimum positions from the ice-surface.

7 Claims, 5 Drawing Figures

ICE-BREAKING APPARATUS FOR SHIPS AND BARGES FOR OPERATION ON ICY WATERS

BACKGROUND OF THE INVENTION (1) Field of the Invention

The present invention relates to an ice-breaking apparatus for facilitating navigation of ships or barges on icy waters.

(2) Brief Description of the Prior Art

Icebreakers or iceboats have been generally used as vessels navigating on icy waters. In vessels of this type, the kinetic energy of the vessel is utilized for breaking ices and in order to obtain a high ice-breaking capacity, therefore, it is necessary to increase the kinetic energy by enlarging the hull or enhancing the power of the main engine and it also is necessary to improve the structure and shape of the hull per se so that the kinetic energy can be transmitted effectively at high efficiency to ices to be broken. Accordingly, attempts have heretofore been made to attain improvements in the foregoing points. In practice, however, in building ships or vessels of this type, various economical and other limitations are imposed on increse of dimensions of the hull or powering-up of the engine, and therefore, no satisfactory ice-breaking capacity can be obtained in many cases.

In general, the ice-breaking operation is divided in two types; namely, continuous ice breaking applied to relatively thin ices and charging ice-breaking applied to thick ices. Continuous ice breaking is performed by thrust of a ship and a knife edge mounted on the bow. Charging ice breaking is performed by repeating an approach run along a certain distance and a collision against ice.

These conventional ice-breaking methods, however, are very inefficient. For example, in case of continuous ice breaking, the advance speed is ordinarily lower than several knots though the speed is changed to some extent depending on the thickness of ice or the capacity of the ship, and in case of charging ice breaking, the opening distance by one charging operation is only in the range of from several meters to several hundred meters. Accordingly, the ice-breaking efficiency is low, especially in case of charging ice breaking, and further, there is always involved a risk that during the ice-breaking operation, the ship will be blocked by ice and will not be allowed to escape.

OBJECTS OF THE INVENTION

The present invention is to eliminate the foregoing defects involved in conventional continuous ice breaking and charging ice breaking by icebreakers or iceboats.

It is therefore a primary object of the present invention to increase the efficiency of continuous ice breaking or charging ice breaking in icebreakers or iceboats navigating on ice waters and barges (inclusive of pushers and tugboats) for operation on ice waters without increasing dimensions of the vessels or powers of main engines thereof.

Another object of the present invention is to moderate dangers involved in charging ice breaking and ensure efficient and safe navigation.

Still another object of the present invention is to provide a distance measuring device for automatically controlling and maintaining the fluid nozzles at optimum positions from the ice-surface.

Other objects and advantages of the present invention will become apparent from the following detailed description.

BRIEF SUMMARY OF THE INVENTION

In accordance with the present invention, the foregoing objects can be attained by an ice-breaking apparatus for ships and barges for operation on icy waters, including nozzles for jetting high pressure fluid to ice to break ice, wherein a rotatable turret is mounted on the bow and nozzles are disposed on an extensible arm attached to said turret or nozzles are disposed on the bow portion, either independent of or in combination with said nozzles disposed on the extensible arm.

According to the present invention, cracks or grooves are formed on ice by the action of high pressure fluid, for example, high pressure water, jetted from the above-mentioned nozzles, whereby the kinetic energy need not be especially increased. Further, since ice is broken only at necessary parts or portions thereof, the operation efficiency can be remarkably enhanced. Moreover, since the hull intrudes into broken or cracked ice, damages on the hull by the ice-breaking operation can be effectively prevented from occurring, and in case of charging ice-breaking, the foregoing risk of stalling in ice can be eliminated.

BRIEF DESCIPTION OF THE DRAWING

DETAILED DESCRIPTION OF PREFERRED EMBODIMENTS

Figure 1:
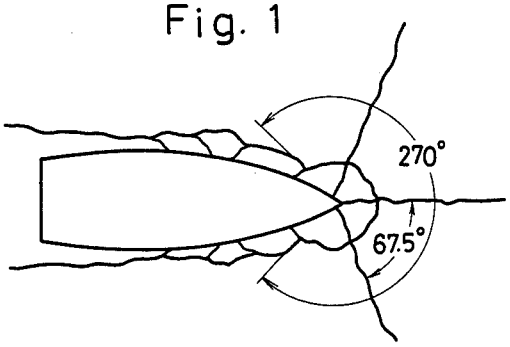
FIG. 1 is a plan view, showing the state where a vessel for operation on ice waters breaks ice.

FIG. 1 illustrates the state where ice is broken according to the customay continuous ice-breaking method. As is seen from FIG. 1, a vessel is allowed to advance through generation and development of cracks on an ice floe and breakage of the ice floe. Accordingly, if a state promoting breakage of an ice floe is artificially realized in advance or conditions for bringing about this state with ease are produced, it will be possible to perform the ice-breaking operation more readily and easily than in the conventional methods.

As means for generating cracks in ice floes, as pointed out hereinbefore, there has been used a knife edge mounted on the bow. In the present invention, an ice-breaking nozzle for jetting high pressure fluid is used instead of such conventional knife edge. One of characteristic features of the present invention resides in the use of such nozzle.

This ice-breaking nozzle may be disposed directly on the bow or it may be supported on an extensible arm mounted on a turret device disposed on the hull. In principle, the present invention includes these two features as main embodiments.

The present invention will now be described in greater detail in conjunction with the accompanying drawings.

Figure 2:
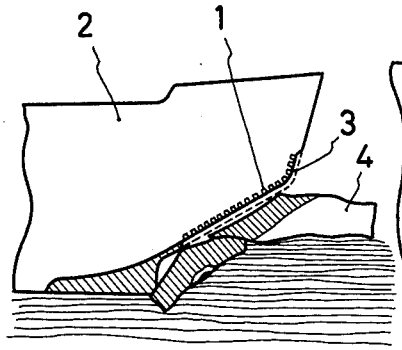
FIG. 2 is a side view of the bow structure equipped with ice-breaking nozzles according to the present invention, which illustrates an embodiment in which ice is thrust down in water and broken.

Referring to FIG. 2 illustrating the structure of the bow portion 2 where a number of nozzles 1 are arranged, the nozzles 1 are embedded in the bottom portion of a groove 3 formed on the bow 2 so that damages of the nozzles by direct contact or collision with ice can be prevented.

High pressure fluid, for example sea water or fresh water stored in the ship, which has been pressurized, is jetted from these nozzles, whereby cracks become formed on ice. Accordingly, the ice-breaking efficiency is enhanced and the sailing speed is elevated. In case of charging ice-breaking, if cuts are formed at the first charging, ice is readily broken at the second charging, and hence, the ice-breaking capacity can be remarkably enhanced.

In the embodiment shown in FIG. 2, ice is thrust down by the bow portion and thus broken. On the other hand, in the embodiment shown in FIG. 3, ice is raised up from below and thus broken. Namely, in the embodiment illustrated in FIG. 2, nozzles are arranged so that cracks are generated from the upper portion of ice 4 and in the embodiment shown in FIG. 3, nozzles are arranged so that cracks are generated from the lower portion of ice 4.

Figure 3:
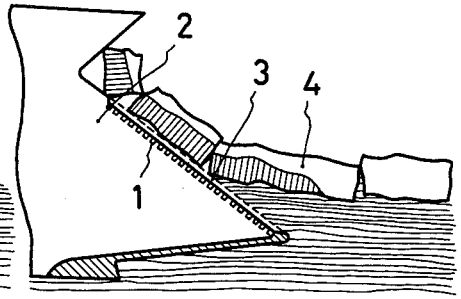
FIG. 3 is a side view of the bow structure equipped with ice-breaking nozzles of the present invention, which illustrates an embodiment in which ice is raised up from below and broken.

When nozzles are disposed in the bow portion as shown in FIGS. 2 and 3, in order to maintain an optimum distance between each nozzle 1 and ice 4 and prevent damages of the nozzles at the time of collision, the nozzles are disposed at a position inner than the position of the shell plating in the bow portion and they are surrounded by electrically heated panels. As means for maintaining a certain distance between the nozzles 1 and ice 4, in the embodiments shown in FIGS. 2 and 3, a groove 3 is formed. Alternatively, an optimum distance can be maintained by depressing only parts of the bow near the nozzles 1.

Figure 4:
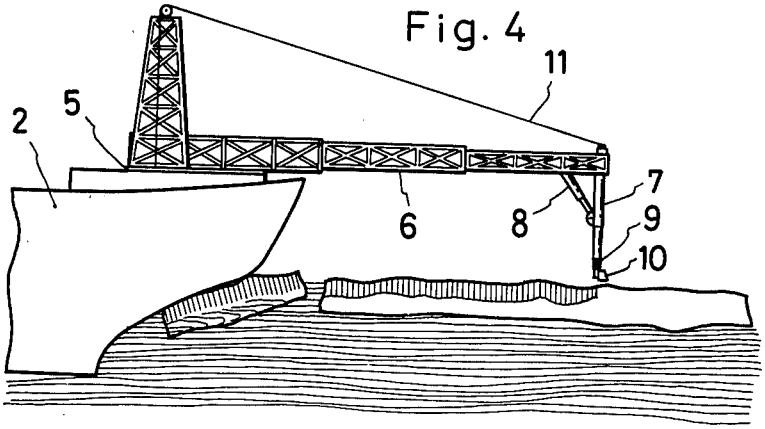
FIG. 4 is a side view of the bow structure equipped with ice-breaking nozzles of the present invention, which illustrates an embodiment in which the nozzles are disposed on an extensible arm on a turret.

FIG. 4 illustrates an embodiment in which a movable type ice-breaking apparatus is mounted on a vessel. In FIG. 4, reference numeral 2 represents the bow portion of an icebreaker or iceboat or barge. A rotatable turret 5 is disposed on the deck, and an extensible arm 6, the length of which can be adjusted, is mounted on this turret 5. On the top end portion of the arm 6, there are arranged a hydraulic device 7 for adjusting the vertical position of nozzles and another hydraulic device 8 for adjusting the nozzle angle, and a head 10 is attached through a damper 9. The top end of the arm 6 is connected to a hydraulic winch through a wire 11. By this winch, the load of the arm and other members is supported, and this winch is operated when a large displacement is required for the head 10.

In the structure shown in FIG. 4, optimum conditions for the ice-breaking nozzles can be optionally selected. More specifically, the distance from the bow, the distance from the ice surface, the cutting angle and other conditions can be appropriately set by operating the extensible arm 6 suitably. Further, distance measuring device including an ultrasonic wave generator and an ultrasonic wave receiver is disposed in the vicinity of the nozzles, and the nozzles are automatically controlled so that they are located at optimum positions from the ice surface irrespective of the convex-concave state of the ice surface and the change of posture of the vessel.

When the ice-breaking apparatus of the present invention is used for continuous ice breaking, breaking of ice in a direction facilitating the advance of the ship is effectively attained or promoted, and the sailing speed can be made much higher than in the case where the ice-breaking apparatus of the present invention is not used. In case of charging ice-breaking, if the ship is stopped at the ice-breaking point and ice is cut or cracked in advance by using the ice-breaking apparatus of the present invention, an easily broken state is brought about in ice, and as compared with the case where the ice-breaking apparatus of the present invention is not used, the critical ice-breaking capacity can be remarkably enhanced.

Figure 5:
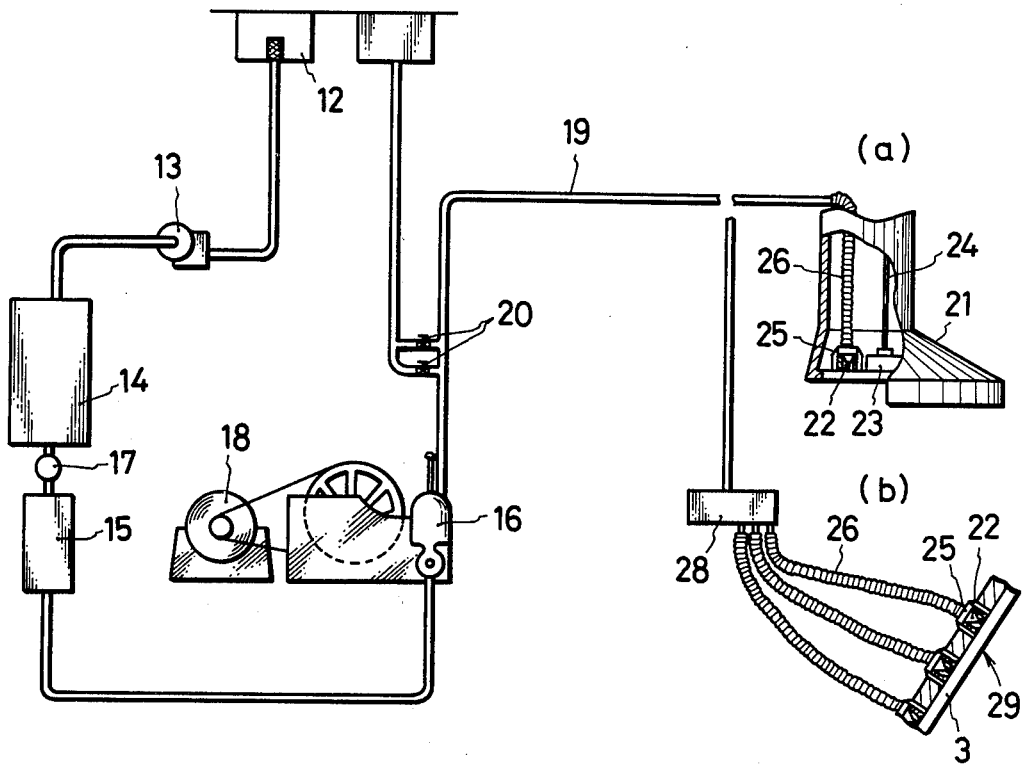
FIG. 5 is a diagram illustrating in detail a head structure and a high pressure water pipe system in the apparatus of the present invention.

FIG. 5 illustrates a head structure and a high pressure water (or sea water) pipe system. Sea water or fresh water in a sea chest or water tank 12 is sucked by a booster pump 13 and passed through a heat exchanger 14 and a filter 15, and the pressure is further elevated by a piston pump 16. A thermometer 17 is disposed between the heat exchanger and the filter, and the piston pump is driven by an electric motor 18. Pressurized water from the piston pump is introduced to the head through a nozzle line 19. A by-pass valve 20 is disposed in the midway of this line to discharge high pressure water in case of emergency. The head includes a type (a) and a type (b). The head (a) is a moving type head. A skirt 21 is attached to prevent the head from being damaged at the time of collision, and in the interior, there are disposed a nozzle 22 and an echo distance measuring device 23. This echo distance measuring device is connected to the interior of the ship through power and signal cables 24. The nozzle is heated by an electrically heated panel 25 so as to prevent freezing of the liquid in the nozzle. For the same reason, a nichrome wire 26 is aligned along the nozzle line.

The head (b) is one to be disposed in the bow structure. High pressure water supplied through a nozzle line 19 is distributed by a control valve 28, passed through a heated pipe 26 and introduced to a designated nozzle 22. The nozzles 22 are arranged on the bottom face of a slit 3 formed on a shell plating 29 of the bow in the state surrounded by an electrically heated panel 25.

In the present invention, an ice floe is broken or breaking of an ice floe is promoted by an impinging force or cavitation caused by jetting of high pressure fluid, and since grooves or cracks promoting breakage of the ice floe can be formed on the ice floe effectively by such impinging force or cavitation, the energy required for breakage of ice can be remarkably reduced according to the present invention.

As will be apparent from the foregoing illustration, according to the present invention, prior to breakage of an ice floe, grooves or cracks are formed on the ice floe, and therefore, breakage of the ice floe can be remarkably facilitated and the ice-breaking capacity of a ship or barge can be enhanced. Moreover, dangers involved in the ice-breaking operation can be drastically diminished and safe and efficient navigation can be ensured. Accordingly, the present invention makes great and valuable contribution to the art.

What is claimed is:

1. An ice-breaking apparatus for a ship or barge for operation on icy waters, comprising:

a turret mounted on a bow portion of the ship or barge;

an extensible arm mounted on said turret;

a head disposed on a leading end portion of said extensible arm, said head including a nozzle for jetting a high pressure fluid against the ice surface; and an echo distance measuring device, said nozzle being automatically controlled by said echo distance measuring device to maintain a certain optimum position relative to the ice surface.

2. An ice-breaking apparatus as claimed in claim 1, wherein said echo distance measuring device comprises an ultrasonic wave generator and an ultrasonic wave receiver.

3. An ice-breaking apparatus as claimed in claim 1, wherein said nozzle is provided with an electrically heated panel for prevention of freezing of the fluid.

4. An ice-breaking apparatus as claimed in claim 1, wherein said head is disposed through a hydraulic device provided at a leading end portion of said arm for adjusting the vertical position of said nozzle.

5. An ice-breaking apparatus as claimed in claim 1, wherein said head is disposed through a hydraulic device provided at a leading end portion of said arm for adjusting the nozzle angle.

6. An ice-breaking apparatus as claimed in claim 1, wherein said head is disposed through a damper provided at a leading end portion of said arm.

7. An ice-breaking apparatus as claimed in claim 1, wherein in addition to said nozzle, a number of nozzles for jetting a high pressure fluid are embedded in a groove formed in the bow plating of the ship or barge.

* * * * *